United States Patent [19]

Jonkers

[11] 3,951,554

[45] Apr. 20, 1976

[54] WRITING APPLIANCE

[76] Inventor: Martinus Karel Petrus Jonkers, Burgemeester Verheugtstraat 49, Mierlo, Netherlands

[22] Filed: Aug. 21, 1974

[21] Appl. No.: 499,116

[52] U.S. Cl. ..... 401/112
[51] Int. Cl. ..... B43k 24/08
[58] Field of Search ..... 401/109–114

[56] References Cited

UNITED STATES PATENTS

| | | | |
|---|---|---|---|
| 3,438,715 | 4/1969 | Bross | 401/112 |

FOREIGN PATENTS OR APPLICATIONS

| | | | |
|---|---|---|---|
| 1,099,569 | 1/1968 | United Kingdom | 401/112 |
| 1,127,669 | 9/1968 | United Kingdom | 401/112 |

*Primary Examiner*—Lawrence Charles
*Attorney, Agent, or Firm*—Finnegan, Henderson, Farabow & Garrett

[57] ABSTRACT

A writing appliance with a retractable stylus actuated into operating position by a reciprocable member against the bias of a spring. The stylus is latched in operating position by a slender elongated flexible member under tension, the flexible member being attached at the outer end with reciprocable member and having at the inner end a cam follower for interaction with a cam surface and a recess on a projection on the inner wall of the shell of the appliance, the flexible member remaining laterally deflected while latched. Upon subsequent reciprocation of the operating member, shaped surfaces on the cam follower and projection guide the inner end of the flexible member around the projection under the stored resilience of the flexible member and the bias of the spring. A guiding arrangement to insure interaction between the cam follower and the projection includes a key on the flexible member which snaps into a slot in the wall of the shell when the stylus is inserted into the shell.

5 Claims, 4 Drawing Figures

WRITING APPLIANCE

BACKGROUND OF THE INVENTION

1. Field of the Invention

The invention relates to a writing appliance comprising a shell tapered at one end, at the other end of which a reciprocable operating member is provided that can cooperate with the means housed in the shell, in order to bring a stylus provided in the shell in the operating position against the action of a spring acting on this stylus and to keep it in that position, or to bring the stylus in the nonoperating position and to keep it in that position, respectively.

2. Description of the Prior Art

Such a writing appliance is among others known from the Dutch patent application No. 278,392, whereby the means mentioned are formed by a cam movable in a longitudinal direction of the shell, which is connected to the operating member, and a ring rotatable around the centre line of the shell, with recesses along the edge opposite the operating member.

In the non-operating position, of the device of the prior art the cam rests in a deep recess of the ring. In bringing the stylus into the operating position, the cam moves out of the recess, when leaving the recess the ring rotates over a small distance and when the operating member is released the cam strikes the lower side of the ring, this lower side being of a sloped step construction. The cam slides over the upper slope along the ring till against the stop formed by above mentioned step. The stylus is now in the operating position. In order to bring the stylus in the non-operating position again, the operating member is pushed in again, the cam is released from said stop and the ring is slightly rotated.

When releasing the operating member of the known device the cam slides over said slope till it snaps in the adjoining deep recess, which recess corresponds with the first mentioned deep recess.

This known mechanism is rather complicated and expensive. It is housed in a shell in which little space is available. If there is more space available in the shell, as e.g. in constructions with an oval, triangular or square cross section or a shell with a large round cross section, then abovementioned mechanism can be simplified to a great extent and therefore becomes less expensive.

SUMMARY OF THE INVENTION

The aim of the invention is to provide a writing appliance with a simple and inexpensive mechanism, for bringing the stylus in the operating or the non-operating position.

According to the invention this aim is attained because the means mentioned are formed by a first cam, or cam follower provided on a flexible shank connected to the operating member mentioned, located between the stylus and the inner wall of the shell, and a second cam or cam projection provided on the inner wall of the shell in the path of the first cam, while on the said remote from said member there is a recess forming a tooth-like projection. Such that when said member is operated in order to bring the stylus from the non-operating position into the operating position, the first cam while the shank bends is moved along the second cam and at the moment of reaching said recess snaps in this recess because of the resilience of the shank and when said member is operated in order to bring the stylus into the non-operating position, the first cam is forced out of the recess and at the moment that it passes the wall of the recess is moved under the second cam because of the resilience in the shank, and then under the influence of the spring engaging the stylus is moved along said lower side and along the side of the second cam opposite the recess into the unloaded starting position.

Because the rotatable ring of the prior art is replaced by a fixed cam provided at the inner wall of the shell, which cam is formed at the same time as the shell is manufactured, the production is cheaper and because at least one loose part, the ring, is omitted, also the assembly is more simple.

Because the shank is located between the stylus and the inner wall of the shell, the stylus can have the usual length and the shank can bend only laterally and not in the plane through the centre line of the writing appliance. Besides, the shank has in the non-operating position no-load, the end of which provided with the cam as well as the shank being free in the middle position.

In order that the first cam enters the recess correctly when operating the member, it is desirable, as is also the case in the abovementioned known device, to limit the stroke of the stylus in the direction of the non-operating to the operating position.

This limitation can be obtained in the embodiment according to the invention in a very simple way, because on said shank another cam or cam shoulder is provided and said second cam, or cam projection has a second recess at the side opposite said first recess, which other cam can engage said second recess and then forms an abutment for the movement of the first cam in the direction of the tapered end of the shell to the first mentioned recess.

For a proper operation it is desired that the cams are always in the correct position relative to one another.

In the embodiment according to the invention, this can be attained in a simple way, because said member and said shell are provided with engaging means in order to guide said member straight, where it is then preferable that said means are at the same time the end abutment for the movement of the shank in the direction from the tapered end of the shell.

BRIEF DESCRIPTION OF THE DRAWING

With the help of a drawing in which an embodiment is shown, the invention is hereafter described in further detail.

DETAILED DESCRIPTION OF THE PREFERRED EMBODIMENTS

Figure 1:
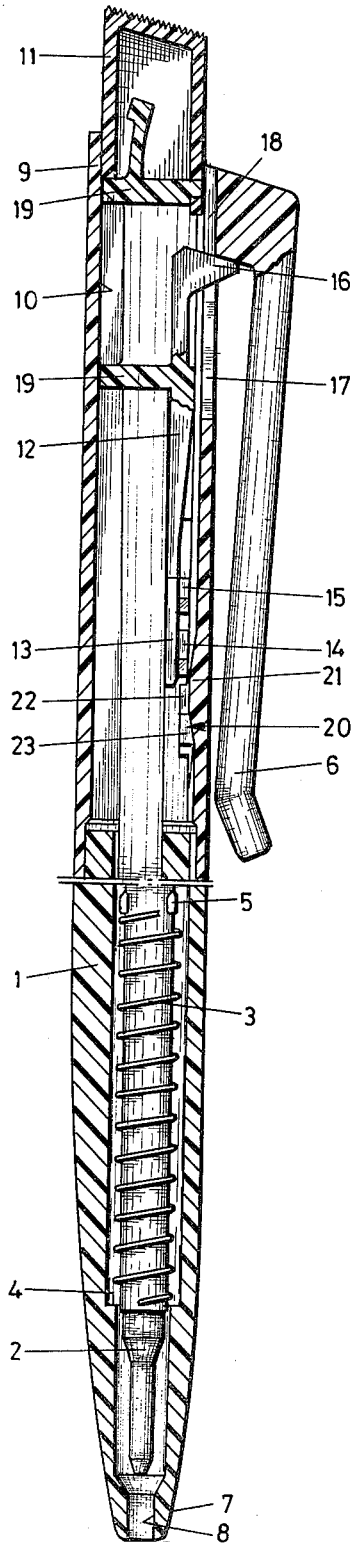
FIG. 1 shows a longitudinal section.

As shown in FIG. 1 the writing appliance consists, as is customary, of a shell 1 in which a stylus 2 is provided around which a spring 3 is located that supports against a shoulder 4 in the shell and a stop 5 on the stylus. In FIG. 1 the stylus 2 is loaded in upward direction by the spring 3. On the shell is found a pocket clip 6. In the end 7 of the shell a guide opening 8 for the stylus is provided and in the end 9 an opening 10, in which the operating member 11 in the form of a push button is located. To the operating member 11 a flexible shank 12 is connected, which has at its plate-shaped free end 13 two cams, cam follower 14 and cam shoulder 15. Between the flexible shank 12 and the operating member 11 a projection 16 is provided, which extends in a slot 17 provided in the wall of the shell 1.

The projection 16 and the slot 17 engage with one another and form a guide for the shank 12 and an end abutment for the movement of the stylus 2 in the direction of the end 9 of the shell 1.

When assembling the writing appliance, the projection 16 is pressed downwards from the top through the channel 18 of the slot and snaps out, when the end of the channel is reached. For exchanging the stylus the projection 16 can be pressed into the channel 18 and moves upwards under the influence of the spring 3.

A further guide of the shank 12 is obtained by the disc-shaped parts 19 of the operating member 11 and by the location of same between the stylus and the inner wall of the shell.

On the inner wall of the shell 1 a cam projection 20 is located. To remove the convexity of the inner wall of the shell a flat face 21 is formed on said wall in such a manner that the cam 20 lies in the same plane as cam follower 14 and cam should 15. The cam 20 is a compound cam and consists of a first surface 22, a second surface 23, a first recess 24 forming a tooth 26, and a second recess forming a stop 25.

The operation is as follows.

Figure 2:
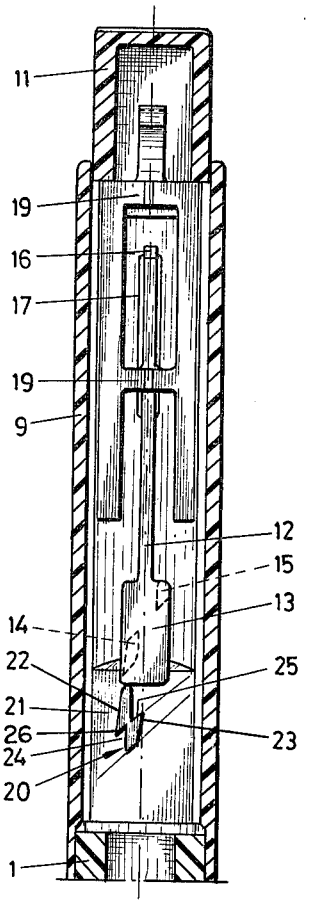
FIG. 2 shows a partial longitudinal section viewed from the left-hand side of FIG. 1, in which for the sake of clearness, the stylus has been omitted.
Figure 3:
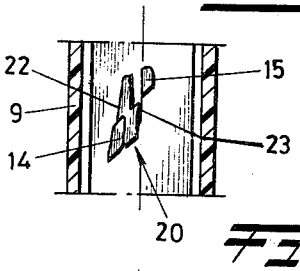
FIGS. 3 and 4 show a detail of FIG. 2 with the cams in different positions.
Figure 4:
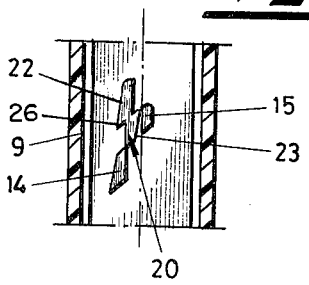

In FIGS. 1 and 2, the stylus 2 is shown in unloaded non-operating position. If now, in order to bring the stylus in the operating position, the operating member 11 is pressed, the cam 14 contacts part 22 of the cam 20. The cam 14 slides (as shown in FIG. 2) over the upper suface of cam part 22 and then moves to the left and thereupon along the left side face of cam part 22 downwards till the cam 15 of the shank contacts the stop 25 of the cam 20. At this moment the cam 14 is before the recess, but cannot yet under the influence of the shank 12, bent in this shape, engage tooth 26. The operating member 11 cannot be pressed any further, because at the moment that the cam 14 is before the recess 24, the cam 15 contacts the stop 25. If the operating member is released, then the cam 15 under the influence of the spring 3 is disengaged of stop 25 (moves slightly back) and the cam 14 snaps into the recess 24 (see FIG. 3). The stylus is now in the operating position. The shank in the plane of FIGS. 2 and 3 is slightly bent and is tension loaded by the effect of the spring 3. If one presses the operating member 11 again, the cam 14 moves along the left side face of surface 23 of cam 20 and the cam 15 moves free of cam 20 along the right side face surface 23 (FIG. 4).

Because the shank is still in a bent position, the cam 14, when reaching the bottom face of surface 23 of cam 20, springs to the right and when releasing the operating member 11, the cam 14 moves under the influence of the spring 3 along said bottom face further to the right, until it is free from this bottom face and then springs back along the right side face of surface 23 to the starting position shown in FIG. 2. The stylus is now in the unloaded non-operating position again.

Because either the projection 16 contacts the lower side of the slot 17, or the enlarged lower side of the stylus contacts the tapered part of the bore of the shell 1, further pressing of the operating member 11 is not possible.

It is obvious that with this invention of the writing appliance, in particular when there is sufficient space in the shell, we have provided a simple and inexpensive mechanism for bringing the stylus in the operating and in the non-operating position.

I claim:

1. In a writing appliance having alternate stable operating and non-operating positions and including a shell having a tapered end, a stylus for insertion through said tapered end in the operating position and for withdrawal therefrom in the non-operating position, said stylus being biased toward the non-operating position, and a reciprocable operating member for actuating said stylus into the operating position, the improvement comprising:

a slender flexible shank connected to said operating member for reciprocation therewith and extending inside said shell;

a cam follower on the inwardly extending end of said flexible shank, said cam follower being positioned between said flexible shank and said inner wall; and a cam projection on the inner wall of said shell for interacting with said cam follower, and thereby laterally deflecting said flexible shank, said cam projection including:

1. a first surface for deflecting the inwardly extending end of said flexible shank from its undeflected position in one lateral direction during the actuation of said stylus into the operating position,
2. a tooth for holding said flexible shank in tension and thereby restraining said operating member connected thereto in the actuating position, and for maintaining said flexible shank in a deflected position, and
3. a second surface for guiding said flexible shank from said deflected restraining position, releasing said flexible shank into its undeflected position under its resiliency, and deflecting said flexible shank in the other lateral direction around said cam projection under the bias on said stylus upon the next reciprocation of said operating member; said stylus being restored to the non-operating position under its bias.

2. The writing appliance of claim 1 further comprising:

a cam shoulder on the inwardly extending end of said flexible shank, said cam shoulder being located between said flexible shank and said inner wall, and said cam shoulder being laterally positioned with respect to said cam follower for movement clear of said cam projection upon movement of said flexible shank from said deflected restraining position into its undeflected position during said next reciprocation; and a stop on said cam projection for abuttingly contacting said cam shoulder, said stop being positioned with respect to said tooth for limiting the movement of said cam follower toward the tapered end of said shell to an engageable position with said tooth upon reciprocation of said operating member for actuating said stylus into the operating position.

3. The writing appliance of claim 1 further comprising:

means for guiding said flexible shank during reciprocation.

4. The writing appliance of claim 3 wherein the guiding means comprise:

a keying projection on said flexible shank;

an axial slot in said shell for guidably receiving said keying projection; and means cooperating with the inner surface of said shell and attached to said operating member.

5. The writing appliance of claim 4 wherein:

the end of said axial slot remote from said tapered end also comprises an abutment for limiting the movement of said flexible shank.

* * * * *